US007748186B2

(12) United States Patent
Voegele, Jr.

(10) Patent No.: US 7,748,186 B2
(45) Date of Patent: Jul. 6, 2010

(54) REDUCED FRICTION FASTENING CLIP ASSEMBLY FOR USE WITH STANDING SEAM ROOF OR WALL PANEL SYSTEMS

(75) Inventor: William P. Voegele, Jr., Pittsburgh, PA (US)

(73) Assignee: Extech/Exterior Technologies, Inc., Pittsburgh, PA (US)

( * ) Notice: Subject to any disclaimer, the term of this patent is extended or adjusted under 35 U.S.C. 154(b) by 0 days.

(21) Appl. No.: 12/533,037

(22) Filed: Jul. 31, 2009

(65) Prior Publication Data

US 2009/0301018 A1 Dec. 10, 2009

Related U.S. Application Data

(62) Division of application No. 11/463,510, filed on Aug. 9, 2006, now Pat. No. 7,661,234.

(60) Provisional application No. 60/706,979, filed on Aug. 10, 2005.

(51) Int. Cl.
*E04C 3/00* (2006.01)
*E04B 2/00* (2006.01)

(52) U.S. Cl. ..... 52/466; 52/459; 52/460; 52/461; 52/465; 52/468; 52/588.1; 52/582.1

(58) Field of Classification Search ..... 52/459–461, 52/465, 466, 468, 470–472, 506.05, 506.06, 52/545, 546, 588.1, 582.1
See application file for complete search history.

(56) References Cited

U.S. PATENT DOCUMENTS

| | | | | | |
|---|---|---|---|---|---|
| 4,135,342 | A * | 1/1979 | Cotter | 52/461 |
| 4,139,974 | A * | 2/1979 | Fox | 52/404.2 |
| 4,481,747 | A * | 11/1984 | Tengesdal et al. | 52/460 |
| 4,570,404 | A * | 2/1986 | Knudson | 52/520 |
| 4,649,684 | A * | 3/1987 | Petree et al. | 52/395 |
| 5,245,808 | A * | 9/1993 | Grunewald et al. | 52/235 |
| 5,265,393 | A * | 11/1993 | Bischel et al. | 52/461 |
| 5,704,509 | A * | 1/1998 | Rosenkrantz | 220/216 |
| 6,164,024 | A * | 12/2000 | Konstantin | 52/200 |
| 2003/0188500 | A1 * | 10/2003 | Voegele | 52/466 |

* cited by examiner

*Primary Examiner*—Brian E Glessner
*Assistant Examiner*—Omar Hijaz
(74) *Attorney, Agent, or Firm*—McKay & Associates, P.C.

(57) ABSTRACT

A roof or wall panel system that includes a first panel having a first longitudinal seam a second panel having a second longitudinal seam, and a clip assembly that includes a vertical web or webs having a first exterior side and a second exterior side. The vertical web or webs and is/are provided between the first and second longitudinal seams. Also included is at least one spacer element that is provided between the first and second longitudinal seams. The at least one spacer element has at least one portion having a thickness that is greater than a distance between the first exterior side and the second exterior side of the vertical web or webs.

8 Claims, 7 Drawing Sheets

REDUCED FRICTION FASTENING CLIP ASSEMBLY FOR USE WITH STANDING SEAM ROOF OR WALL PANEL SYSTEMS

CROSS-REFERENCE TO RELATED APPLICATION

This application is a divisional application of U.S. Ser. No. 11/463,510, filed Aug. 9, 2006, now U.S. Pat. No. 7,661,234 which further claims the benefit of U.S. Provisional Application No. 60/706,979, entitled "Reduced Friction Fastening Clip Assembly for Use with Standing Seam Roof for Wall Panels," which was filed on Aug. 10, 2005, the disclosure of which is incorporated herein by reference.

FIELD OF THE INVENTION

The present invention relates to standing seam roof or wall panel systems, and in particular to a standing seam roof or wall panel system that employs a reduced friction fastening clip assembly.

BACKGROUND OF THE INVENTION

It is well known to secure standing seam roof and wall panels, including translucent panels, to purlin or girt substrates using hidden clips and related clip assemblies. Examples of various of these clip assemblies are shown in U.S. Pat. Nos. 4,184,299, 4,193,247, 4,261,998, 4,495,743, 4,543,760, 4,575,983, 5,001,882, 5,181,360, 5,222,341, 5,363,624, 5,606,838 and 6,164,024. As noted in this prior art, a continuing problem has existed concerning the impact of thermal forces (expansion and contraction) on panels supported and joined together by clip assemblies. By way of example, if clip assemblies are too rigid, damage may occur to the panels or clip assemblies during thermal expansion or contraction. In addition, undesirable noises and wear are caused by frictional panel movement resulting from thermal and other forces, i.e. panels rubbing against the clip assembly, against the fasteners that hold the clip assembly, and against the substrates. Thus, there is a need for a clip assembly for a panel system that reduces the potential for undesirable frictional forces.

SUMMARY OF THE INVENTION

In one embodiment, the invention relates to a roof or wall panel system that includes a first panel (e.g., a standing seam panel) having a first longitudinal seam (e.g., an upstanding seam), a second panel (e.g., a standing seam panel) having a second longitudinal seam (e.g., an upstanding seam), and a clip assembly. The clip assembly includes a first vertical web having a first exterior side and a second vertical web having a second exterior side. The first vertical web and the second vertical web are provided between the first and second longitudinal seams. Also included is at least one spacer element that is provided between the first and second longitudinal seams. The at least one spacer element has at least one portion having a thickness that is greater than the distance between the first exterior side of the first vertical web and the second exterior side of the second vertical web. Preferably, when at least a portion of the first longitudinal seam bears against the at least one spacer element, the first longitudinal seam is prevented from bearing substantially against the first exterior side of the first vertical web and when at least a portion of the second longitudinal seam bears against the at least one spacer element, the second longitudinal seam is prevented from bearing substantially against the second exterior side of the first vertical web.

In one particular embodiment, the first vertical web is disposed adjacent to and separated from the second vertical web. In addition, the at least one spacer element may include a first end portion, a second end portion, and a central portion located between the first end portion and the second end portion, wherein the central portion of the spacer element is disposed between the first vertical web and the second vertical web. In this embodiment, the first end portion has a first thickness measured between a first exterior face and a second exterior face thereof and the second end portion has a second thickness measured between a third exterior face and a fourth exterior face thereof. The first and second thicknesses are each greater than the distance between said first exterior side of the first vertical web and the second exterior side of the second vertical web. Preferably, when at least a portion of the first longitudinal seam bears against one or both of the first and third exterior faces, the first longitudinal seam is prevented from bearing substantially against the first exterior side of the first vertical web and when at least a portion of the second longitudinal seam bears against one or both of the second and fourth exterior faces, the first longitudinal seam is prevented from bearing substantially against the second exterior side of the second vertical web.

The at least one spacer element may be free to move in a direction between the first vertical web and the second vertical web that is substantially parallel to the length of the clip assembly. Alternatively, the at least one spacer element may be attached to one or both of the first longitudinal seam and the second longitudinal seam.

The first vertical web may be part off a first clip element that includes a first top flange and a first base flange, aid the second vertical web may be part of a second clip element that includes a second top flange and a second base flange. The first clip element and the second clip element may be fastened to a substrate by one or more fasteners inserted through the first and second base flanges. In one embodiment, the first base flange is positioned on top of the second base flange. The clip assembly may also further include a base spacer element on which one or both of the first base flange and the second base flange rest. The base spacer element has a first upright leg and a first supporting flange extending therefrom and a second upright leg and a second supporting flange extending therefrom, wherein the first panel is supported by the first supporting flange and the second panel is supported by the second supporting flange.

In another particular embodiment, the second vertical web includes a first portion that is spaced from the first vertical web and a second portion that touches the first vertical web. In this embodiment, the second portion may be attached to the first vertical web. Further, the first vertical web and the second vertical web and their associated flanges may be joined as one clip, as formed, e.g., as an extrusion.

In another embodiment, the invention relates to a clip assembly for a roof or wall panel system that includes a first vertical web having a first exterior side and a second vertical web having a second exterior side, wherein the second vertical web is disposed adjacent to and separated from the first vertical web. The clip assembly further includes a spacer element having a first end portion, a second end portion, and a central portion located between the first end portion and the second end portion. The central portion of the spacer element is disposed between the first vertical web and the second vertical web. The first end portion has a first thickness measured between a first exterior face and a second exterior face thereof and the second end portion has a second thickness measured between a third exterior face and a fourth exterior face thereof, wherein the first and second thicknesses are each greater than a distance between the first exterior side of the first vertical web and the second exterior side of the second vertical web.

In still another embodiment, the invention relates to a spacer element for a clip assembly for a roof or wall panel system having a first vertical web having a first exterior side and a second vertical web having a second exterior side. The spacer element includes a first end portion, a second end portion, and a central portion located between the first end portion and the second end portion. The central portion is structured to be received between the first vertical web and the second vertical web. The first end portion has a first thickness measured between a first exterior face and a second exterior lace thereof and the second end portion has a second thickness measured between a third exterior face and a fourth exterior face thereof. The first and second thicknesses are each greater than a distance between the first exterior side of the first vertical web and the second exterior side of the second vertical web.

In still another embodiment, the invention relates to a roof or wall panel system that includes a first panel having a first longitudinal seam, a second panel having a second longitudinal seam, a clip having a vertical web having a first exterior side and a second exterior side, the vertical web being provided between the first and second longitudinal seams, and at least one spacer element having at least one portion provided between the first and second longitudinal seams. The at least one portion of the spacer element has a thickness that is greater than the distance between the first exterior side and the second exterior side of the vertical web. In one particular embodiment, the clip includes first and second top flanges, and the at least one spacer element includes a central portion structured to rest on the first and second top flanges, a first leg depending downwardly from a first end of the central portion, a first contact portion attached to the first leg, a second leg depending downwardly from a second end of the central portion, and a second contact portion attached to the second leg. The first and second contact portions are disposed between the first and second longitudinal seams. The first contact portion has a first thickness and the second contact portion has a second thickness, wherein the first and second thicknesses are each greater than the distance between the first exterior side and the second exterior side of the vertical web. The clip in this embodiment may be a one-piece (e.g., extruded) clip, or may be a two or more piece clip wherein the vertical web includes a first vertical web portion having the first exterior side and a second vertical web portion having the second exterior side. Preferably, the system includes a batten fitted over the first and second longitudinal seams, wherein the central portion of the spacer element is received within the space that exists between the interior of the batten and the top side of each of the first and second longitudinal seams.

In still another embodiment, the invention relates to a spacer element for a roof or wall panel system having a clip heaving first and second top flanges and a vertical web having a first exterior side and a second exterior side. The spacer element includes a central portion structured to rest on the first and second top flanges, a first leg depending downwardly from a first end of the central portion, a first contact portion attached to the first leg, a second leg depending downwardly from a second end of the central portion, and a second contact portion attached to the second leg. The first contact portion has a first thickness and the second contact portion has a second thickness, wherein the first and second thicknesses are each greater than the distance between the first exterior side and the second exterior side of the vertical web.

Therefore, it should now be apparent that the invention substantially achieves all the above aspects and advantages. Additional aspects and, advantages of the invention will be set forth in the description that follows, and in part will be obvious from the description, or may be learned by practice of the invention. Moreover, the aspects and advantages of the invention may be realized and obtained by means of the instrumentalities and combinations particularly pointed out in the appended claims.

BRIEF DESCRIPTION OF THE DRAWINGS

The accompanying drawings illustrate presently preferred embodiments of the invention, and together with the general description given above and the detailed description given below, serve to explain the principles of the invention. As shown throughout the drawings, like reference numerals designate like or corresponding parts.

DESCRIPTION OF THE PREFERRED EMBODIMENTS

Figure 1:
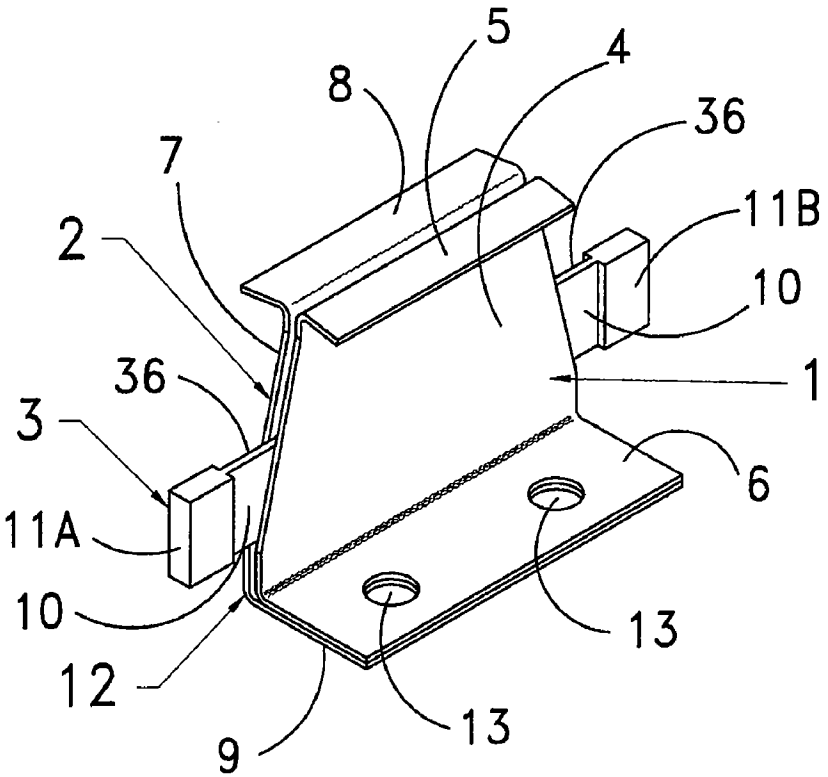
FIG. 1 is an isometric view of a clip assembly for use in a standing seam panel (e.g., roof or wall) system according to one embodiment of the present invention.

FIG. 1 is an isometric view of a clip assembly for use in a standing seam panel (e.g., roof or wall) system according to one embodiment of the present invention. The clip assembly shown in FIG. 1 includes a channel-shaped clip 1 adjoining a Z-shaped clip 2. The clip 1 includes a vertical web 4, a top flange 5, and a bottom flange 6. Similarly, the clip 2 includes a vertical web 7, a top flange 8, and a bottom flange 9. The vertical webs 4 and 7 of the channel-shaped clip 1 and the Z-shaped clip 2, respectively, are separated by a spacer element 3. The clips I and 2 are typically made of sheet metal such as stainless steel and spacer element 3 may be made of any suitable material such as metal (e.g., in the form of an aluminum extrusion) or plastic (e.g., in the form of polycarbonate or some other clear plastic).

Figure 3:
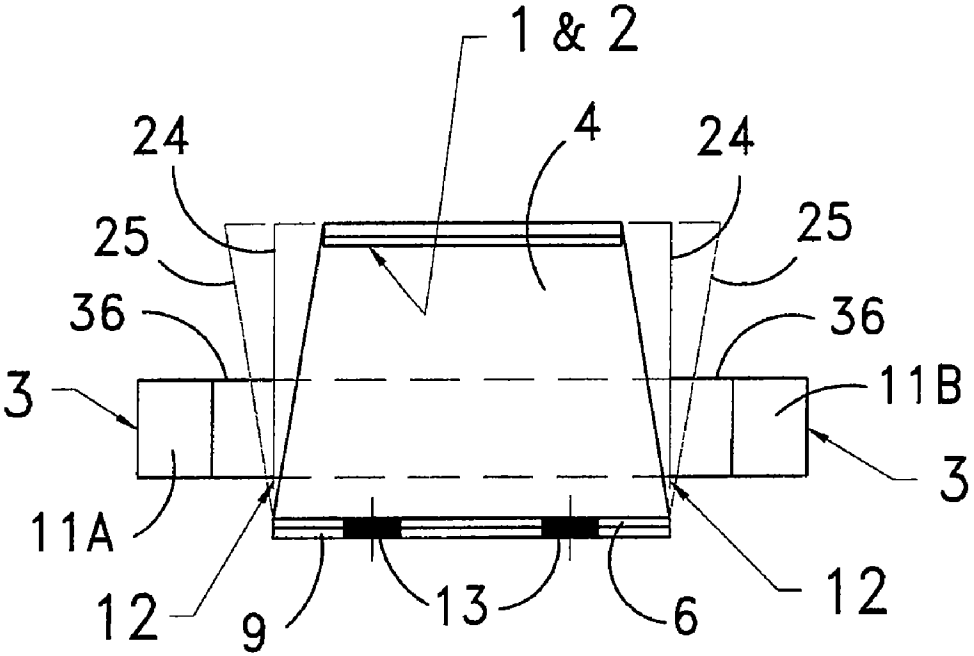
FIG. 3 is a side view of the clip assembly shown in FIG. 1.
Figure 4:
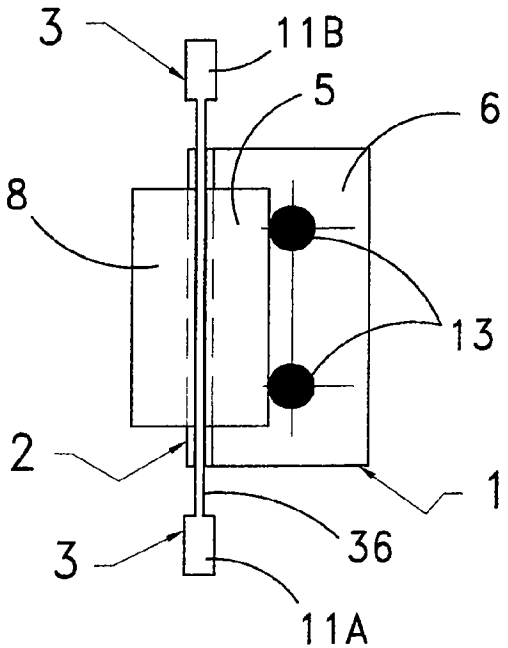
FIG. 4 is a top plan view of the clip assembly shown in FIG. 1.

As most readily seen in FIGS. 1, 3 and 4, the spacer element 3 includes a narrow central portion 36, a first end 11A and a second end 11B opposite the first end 11 A. The first and second ends 11A and 11B each have a thickness that is greater than the thickness of the central portion 36. The significance of this difference in thicknesses is described in greater detail herein.

One or more holes 13 pass through the flanges 6 and 9 of the clips 1 clip 2, respectively, and are provided for receiving a fastener 14 (FIG. 2), such as a screw, for fastening the aligned clips 1 and 2 to a substrate such as a purlin or girt. The holes 13 are preferably positioned through flanges 6 and 9 in a manner that defines the space between the upright webs 4 and 7. A spacer element 12 is positioned between the webs 4 and 7 and under the spacer element 3 for the purpose of providing a resting place upon which the spacer element 3 is supported. Preferably, the spacer element 12 is slightly wider than the central portion 36 of the spacer element 3. In addition, the spacer element 3 is, in this manner, free to move longitudinally between the clips 1 and 2 (i.e., between the webs 4 and 7).

Figure 2A:
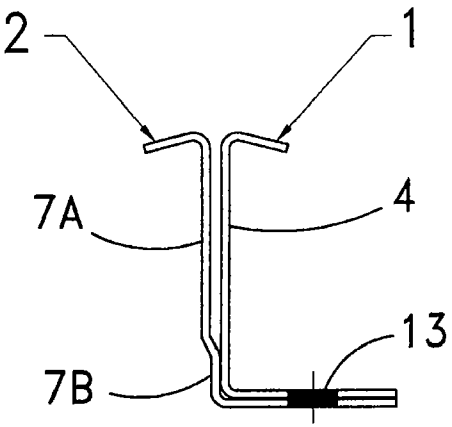
FIG. 2A is an end view of an alternative embodiment of the clips forming a part of the clip assembly shown in FIG. 1.
Figure 2:
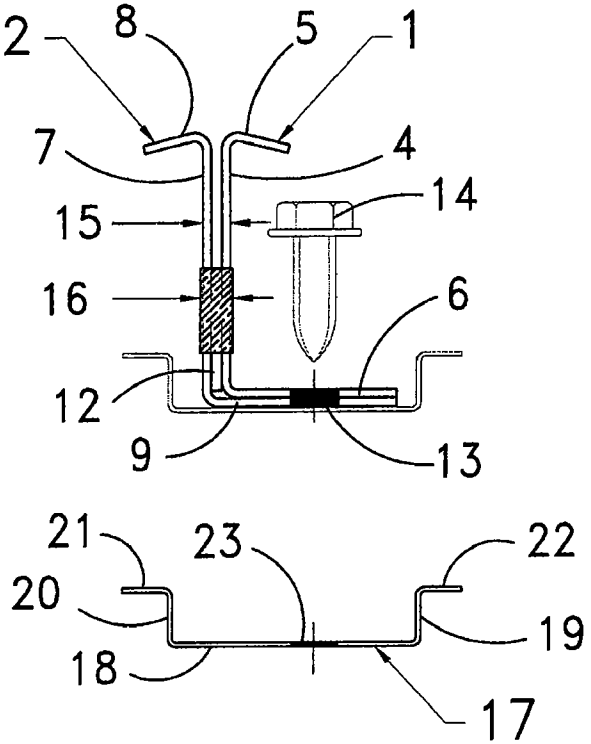
FIG. 2 is an end view of the clip assembly shown in FIG. 1.

FIG. 2 shows an end view of the clip assembly shown in FIG. 1 having the upper flanges 5 and 8, the lower flanges 6 and 9, the holes 13, and the fastener 14 as described above. A dimension 15, which is the distance between the outer surfaces of the webs 4 and 7, is illustrated in FIG. 2 and is preferably approximately ⅛". A dimension 16, which is the thickness of the ends 11A and 11B of spacer element 3, is also shown. The dimension 16 is greater than the dimension 15, preferably by approximately 0.020". At the bottom of FIG. 2, shown in an exploded position, is a base spacer element 17. The base spacer element 17 is also shown in phantom lines in the top of FIG. 2, which illustrates the typical positioning of the base spacer element 17 under the lower flanges 6 and 9 of the clip assembly. The spacer element 17 includes upright legs 19 and 20 and supporting flanges 21 and 22. The supporting flanges 21 and 22 provide support for standing seam panels 27 and 28 as is shown in FIG. 5 by allowing the standing seam panels 27 and 28 to rest thereon.

FIG. 2A shows an alternative embodiment of the clips 1 and 2. In this embodiment, the web 7 of the clip 2 is deformed so as to provide a first portion 7A that is separated from the web 4 of the clip 1 and a second portion 7B that touches the web 4 of the clip 1. The clips 1 and 2 may be welded, or otherwise adhered, where they touch.

FIG. 3 is a side view of the clip assembly shown in FIG. 1 and further defines several of the features. FIG. 3 illustrates that the webs 4 and 7 of the clips 1 and 2 may be tapered such that the top flanges 5 and 8 have length that is shorter the length of the bottom flanges 6 and 9. The dotted lines 24 in FIG. 3 illustrate that the length of the top flanges 5 and 8 can, alternatively, be about the same as the length of the bottom flanges 6 and 9. The dotted lines 25 in FIG. 3 illustrate that the length of the top flanges 5 and 8 can, alternatively, be longer than the length of the bottom flanges 6 and 9. In any case, the inner (thin) central portion 36 of the spacer element 3 is sufficiently long to allow the spacer element 3 to move in the longitudinal direction with the thermal movement (expansion and contraction) of the standing seam panels 27 and 28 (FIG. 5), while the clip assembly including the clips 1 and 2 is designed to constrain the standing seam panels from upward motion. FIG. 4 is a top plan view of the clip assembly shown in FIG. 1 which illustrates a preferred length of the spacer element 3.

Figure 5:
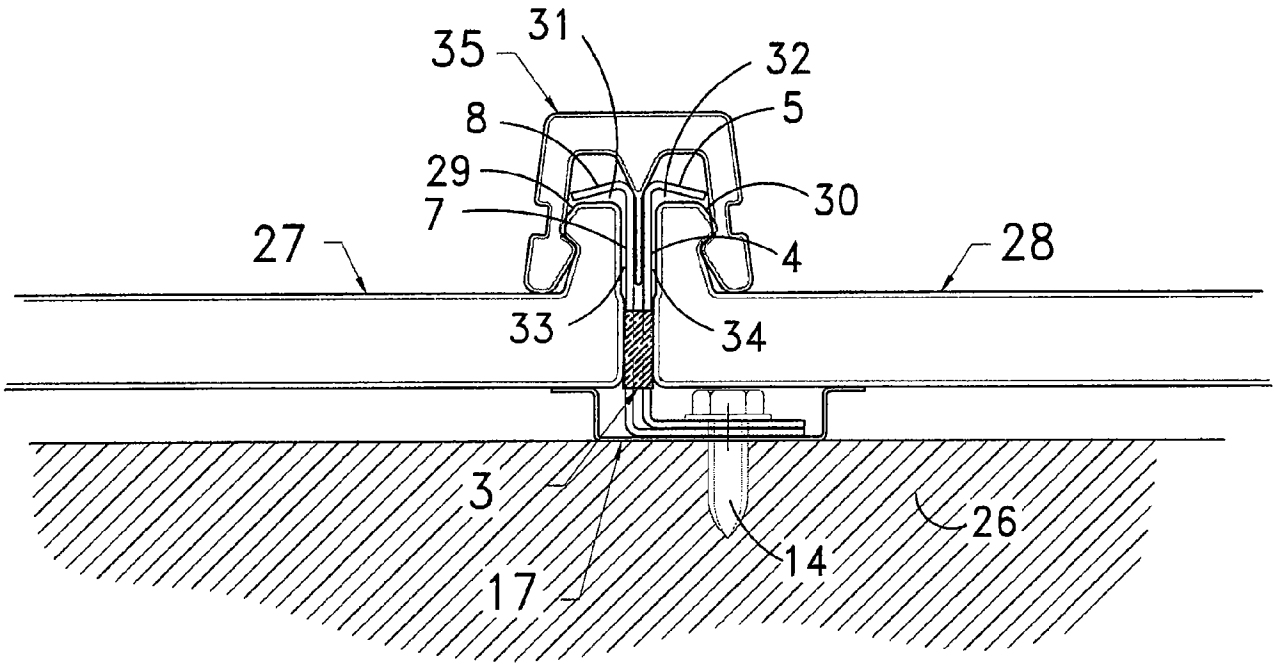
FIG. 5 is an end view of the clip assembly shown in FIG. 1 forming a part of a standing seam panel system.

FIG. 5 is an end view of the clip assembly shown in FIG. 1 inserted within a standing seam panels system that includes standing seam panels 27 and 28 having upstanding seams 29 and 30, respectively, and snap-on batten 35 shown in cross section. The standing seam panels 27 and 28 and snap-on batten 35 may be composed of metal or of plastics, including light transmitting plastics, such as polycarbonate. The clip assembly is fastened to a substrate 26 via fasteners 14. The standing seam panels 27 and 28 rest upon the upper flanges 21 and 22 of the base spacer element 17, as previously described. The top flanges 5 and 8 of the clips I and 2, respectively, are located sufficiently high so as to leave gaps 31 and 32 between the top flanges 5 and 8 and the tops of the respective upstanding seams 29 and 30. The gaps 31 and 32 are provided to, among other things, compensate for dimensional tolerances in the substrates. The spacer element 3, and in particular the ends 11 A and 11B. is of sufficient width to maintain a separation between the standing seam panels 27 and 28 such that the standing seam panels 27 and 28 do not bear tightly against web portions 4 and 7, thus leaving a gap 33 and/or a gap 34 therebetween. The gaps 33 and 34 are sufficient to allow longitudinal movement of the standing seam panels 27 and 28, such as would result from thermal expansion and contraction of the panels 27 and 28 and the batten 35, without causing significant frictional contact between the standing seam panels 27 and 28 and the web portions 4 and 7. As a result, the potential for wear and/or noise due to friction is reduced.

Figure 6:
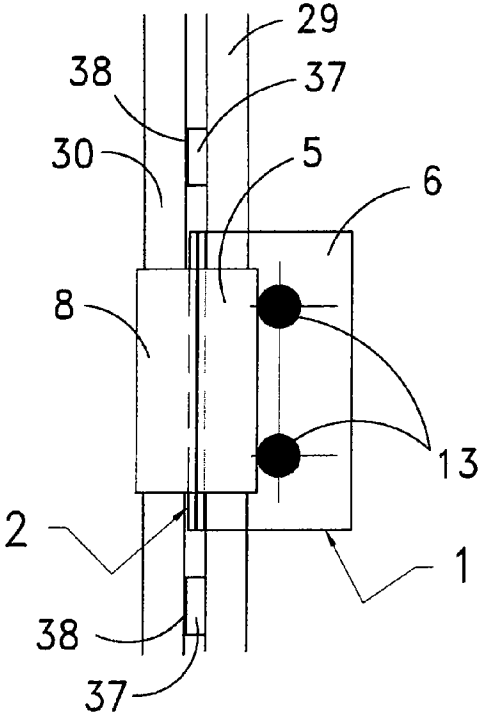
FIG. 6 is a top plan view of a clip assembly for use in a standing seam panel (e.g., roof or wall) system according to all alternative embodiment of the present invention.

FIG. 6 is a top plan view of a clip assembly for use in a standing seam panel (e.g., roof or wall) system according to an alternative embodiment of the present invention. As seen in FIG. 6, the clip assembly shown therein is similar to the clip assembly shown in FIGS. 1-5 and includes a channel-shaped clip 1 having a vertical web, a top flange 5 and a bottom flange 6 adjoining a Z-shaped clip 2 having a vertical web, a top flange 8, and a bottom flange 9. The clip assembly shown in FIG. 6 forms a part of a panel system that includes adjacent standing seam panels having upstanding seams 29 and 30 similar to those shown in FIG. 5. One or more spacer elements 37 are provided between the upstanding seams 29 and 30.

Preferably, each spacer element 37 is attached to one or both of the panels, such as by an adhesive 38 or a tack forming a part of the spacer element 37 that is inserted into the panel. The spacer elements 37 may be made of any suitable material such as metal (e.g., in the form of an aluminum extrusion) or plastic (e.g., in the form of polycarbonate or some other clear plastic) and preferably have a round or box-like shape. The spacer elements 37 each have a width that is sufficient to maintain a separation between the standing seam panels (and in particular the upstanding seams 29 and 30 thereof) such that the standing seam panels 27 and 28 do not simultaneously bear tightly against each of the web portions of the clips 1 and 2, thus leaving a gap on either or both sides thereof at any given time. Preferably, the width of each spacer element 37 is greater than a distance between the outside surfaces of the web portions of the clips 1 and 2. In addition, the gap or gaps are sufficient to allow longitudinal movement of the standing seam panels 27 and 28, such as would result from thermal expansion and contraction of the panels and a batten used therewith, without causing significant fictional contact between the upstanding seams 29 and 30 and the web portions of the clips 1 and 2. As a result, the potential for wear and/or noise due to friction is reduced.

Figure 7:
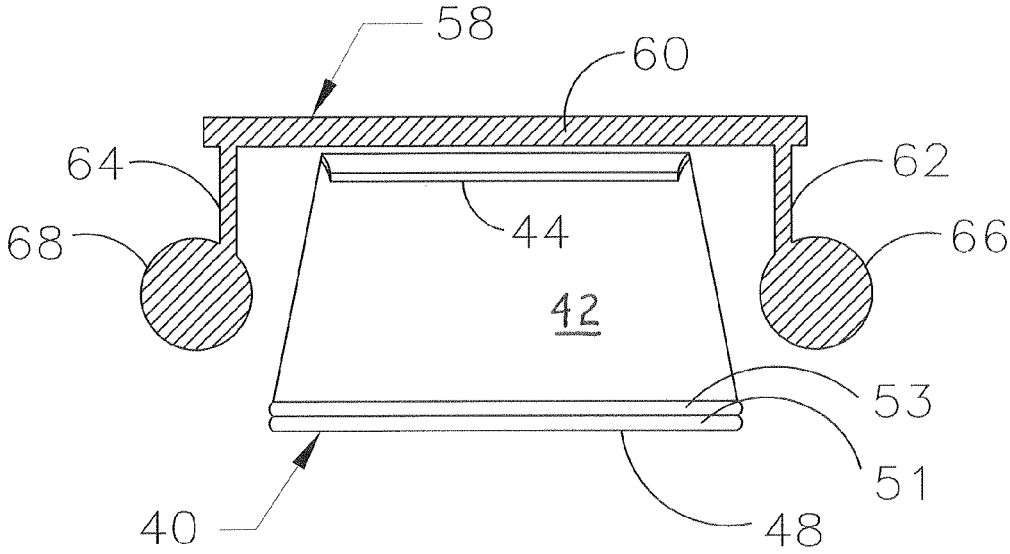
FIGS. 7 and 8 are side and end views, respectively, of a clip assembly for use in a standing seam panel (e.g., roof or wall) system according to a further alternative embodiment of the present invention.
Figure 8:
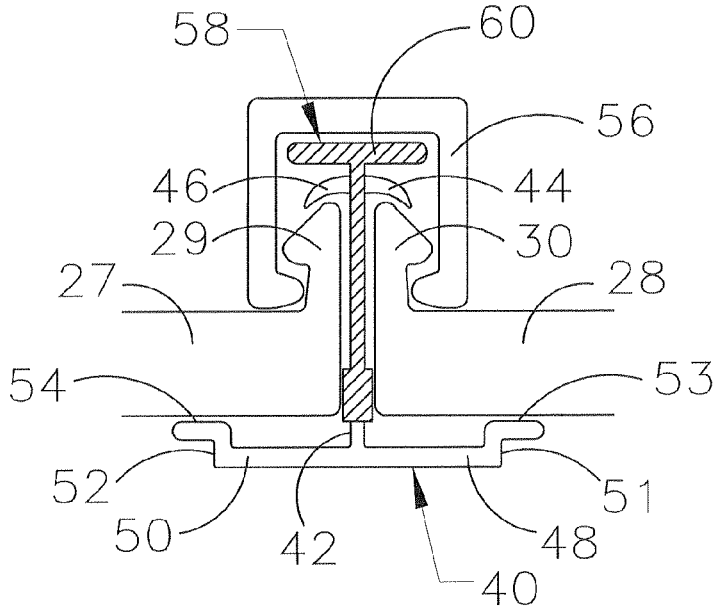

FIGS. 7 and 8 are side and end views, respectively, of a clip assembly for use in a standing seam panel (e.g., roof or wall) system (shown in FIG. 8) according to a further alternative embodiment of the present invention. As seen in FIGS. 7 and 8, the clip assembly shown therein includes a one-piece clip 40 (e.g., a one-piece extruded clip made of a material such as aluminum) having a vertical web 42, top flanges 44 and 46 and bottom flanges 48 and 50. The bottom flanges 48 and 50 have upright legs 51 and 52 and supporting flanges 53 and 54, respectively. The supporting flanges 53 and 54 provide support for standing seam panels 27 and 28 as is shown in FIG. 8 by allowing the standing seam panels 27 and 28 to rest thereon. Although a one-piece clip 40 is shown in FIGS. 7 and 8, it should be understood that a two or more piece clip may also be used.

The clip assembly shown in FIGS. 7 and 8 forms a part of a panel system that, as described above, includes adjacent standing seam panels 27 and 28 having upstanding seams 29 and 30 and a snap-on batten 56 which is fitted over the upstanding seams 29 and 30 of the adjacent panels 27 and 28. As shown in FIGS. 7 and 8, a spacer element 58 as is provided in the space that exists between the interior of the batten 56 and the tops of the upstanding seams 29 and 30 of the adjacent panels 27 and 28. In particular, the spacer element 58 includes an elongated central portion 60 having a first depending leg 62 extending downwardly from a first end thereof and a second depending leg 64 extending downwardly from a second end thereof. A first contact portion 66 is connected to the end of the first depending leg 62 and a second contact portion 68 is connected to the end of the second depending leg 64. Preferably the contact portions 66 and 68 each have a round or box-like shape.

As seen FIGS. 7 and 8, the central portion 60 of the spacer element 58 is structured to rest on top of the top flanges 44 and 46 of the clip 40 to position the contact portions 66 and 68 between the adjacent upstanding seams 29 and 30 of the panels 27 and 28. In addition, the contact portions 66 and 68 each have a width that is sufficient to maintain a separation between the standing seam panels (and in particular the upstanding seams 29 and 30 thereof) such that the standing seam panels 27 and 28 do not simultaneously bear tightly against the outside surfaces of the web 42 of the clip 40, thus leaving a gap on either or both sides thereof at any given time. Preferably, the width of each of the contact portions 66 and 68 is greater than a distance between the outside surfaces of the web 42 of the clip 40. In addition, the gap or gaps are sufficient to allow longitudinal movement of the standing seam panels 27 and 28, such as would result from thermal expansion and contraction of the panels 27 and 28 and the batten 56 used therewith, without causing significant frictional contact between the upstanding seams 29 and 30 and the outside surfaces of the web 42. As a result, the potential for wear and/or noise due to friction is reduced.

The spacer element 58 may be made of any suitable material such as metal (e.g., in the form of an aluminum extrusion) or plastic (e.g., in the form of polycarbonate or some other clear plastic).

While preferred embodiments of the invention have been described and illustrated above, it should be understood that these are exemplary of the invention and are not to be considered as limiting. Additions, deletions, substitutions, and other modifications can be made without departing from the spirit or scope of the present invention. Accordingly, the invention is not to be considered as limited by the foregoing description but is only limited by the scope of the appended claims.

I claim:

1. A roof or wall panel system, comprising:

a first panel having a first longitudinal seam;

a second panel having a second longitudinal seam;

a clip having first and second top flanges and a vertical web having a first exterior side and a second exterior side, said vertical web being provided between said first and second longitudinal seams;

at least one spacer element having at least one portion provided between said first and second longitudinal seams, said at least one portion having a thickness that is greater than a distance between said first exterior side and said second exterior side of said vertical web, and wherein said at least one spacer element includes a central portion structured to rest on said first and second top flanges, a first leg depending downwardly from a first end of said central portion, a first contact portion attached to said first leg, a second leg depending downwardly from a second end of said central portion, and a second contact portion attached to said second leg, wherein said first and second contact portions are disposed between said first and second longitudinal seams, and wherein said first contact portion has a first thickness and said second contact portion has a second thickness, said first and second thicknesses each being greater than the distance between said first exterior side and said second exterior side of said vertical web.

2. The roof or wall panel system according to claim 1, wherein said clip is a one-piece clip.

3. The roof or wall panel system according to claim 1, wherein said vertical web includes a first vertical web portion having said first exterior side and a second vertical web portion having said second exterior side.

4. The roof or wall panel system according to claim 1, wherein said first vertical web portion is separated from said second vertical web portion.

5. The roof or wall panel system according to claim 1, further comprising a batten fitted over said first and second longitudinal seams, wherein said central portion is received within a space between an interior of said batten and a top side of each of said first and second longitudinal seams.

6. The roof or wall panel system according to claim 1, wherein said at least one spacer element is attached to one or both of said first longitudinal seam and said second longitudinal seam.

7. The roof or wall panel system according to claim 6, wherein said at least one spacer element is a single spacer element attached to one or both of said first longitudinal seam and said second longitudinal seam.

8. The roof or wall panel system according to claim 7, wherein said single spacer element has a thickness that is greater than the distance between said first exterior side and said second exterior side of said vertical web.

* * * * *